US009840805B2

(12) United States Patent
Leonard et al.

(10) Patent No.: US 9,840,805 B2
(45) Date of Patent: Dec. 12, 2017

(54) METHODS FOR DETERMINING LOAD MASS IN WASHING MACHINE APPLIANCES

(71) Applicant: General Electric Company, Schenectady, NY (US)

(72) Inventors: Ryan Ellis Leonard, Louisville, KY (US); Stephen Edward Hettinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 223 days.

(21) Appl. No.: 14/741,630

(22) Filed: Jun. 17, 2015

(65) Prior Publication Data

US 2016/0369446 A1 Dec. 22, 2016

(51) Int. Cl.

| | |
|---|---|
| ***D06F 39/00*** | (2006.01) |
| ***D06F 33/02*** | (2006.01) |
| ***D06F 23/04*** | (2006.01) |

(52) U.S. Cl.

CPC ..... *D06F 39/003* (2013.01); *D06F 33/02* (2013.01); *D06F 23/04* (2013.01); *D06F 2202/12* (2013.01); *D06F 2204/065* (2013.01); *D06F 2220/00* (2013.01)

(58) Field of Classification Search

CPC ..... D06F 39/003; D06F 33/02; D06F 23/04; D06F 2202/65; D06F 2202/10; D06F 2202/12; D06F 2204/065; D06F 2220/00

See application file for complete search history.

(56) References Cited

U.S. PATENT DOCUMENTS

| | | | | |
|---|---|---|---|---|
| 5,208,931 | A * | 5/1993 | Williams | D06F 39/003 68/12.04 |
| 5,271,116 | A * | 12/1993 | Williams | D06F 39/003 68/12.05 |
| 6,550,290 | B2 * | 4/2003 | Shimakage | D06F 39/003 68/12.04 |
| 6,842,928 | B2 | 1/2005 | Yang et al. | |
| 7,555,798 | B2 | 7/2009 | Kim et al. | |

(Continued)

FOREIGN PATENT DOCUMENTS

| | | |
|---|---|---|
| EP | 1 428 925 A1 | 6/2004 |
| EP | 2 194 180 A2 | 6/2010 |
| WO | WO 2009/093166 A1 | 7/2009 |

*Primary Examiner* — Joseph L Perrin

(74) *Attorney, Agent, or Firm* — Dority & Manning, P.A.

(57) ABSTRACT

Washing machine appliances and methods for determining load masses are provided. A method includes accelerating rotation of a basket of the washing machine appliance from a first speed to a second speed greater than the first speed and for a predetermined time measured for acceleration of the basket from the first speed; measuring, during the accelerating step, a check speed of the basket at the predetermined time; and measuring, during the accelerating step, an acceleration time for the tub to accelerate from the first speed to the second speed. The method further includes discontinuing acceleration of the basket after the second speed and the predetermined time have reached; and measuring a coast time for coasting of the basket from the check speed to the first speed. The method further includes determining a load mass in the basket based on the check speed, the acceleration time, and the coast time.

17 Claims, 4 Drawing Sheets

(56) References Cited

U.S. PATENT DOCUMENTS

| | | | | |
|---|---|---|---|---|
| 7,958,584 | B2 | 6/2011 | Suel, II et al. | |
| 8,914,930 | B2 | 12/2014 | Chanda et al. | |
| 2005/0086742 | A1* | 4/2005 | Kim | D06F 39/003 8/158 |
| 2008/0041115 | A1* | 2/2008 | Kanazawa | D06F 33/02 68/12.04 |
| 2011/0247148 | A1* | 10/2011 | Chanda | D06F 33/02 8/137 |
| 2012/0005840 | A1* | 1/2012 | Jang | D06F 33/02 8/137 |
| 2013/0185872 | A1 | 7/2013 | Chanda et al. | |
| 2015/0292136 | A1* | 10/2015 | Leonard | D06F 33/02 8/147 |

* cited by examiner

METHODS FOR DETERMINING LOAD MASS IN WASHING MACHINE APPLIANCES

FIELD OF THE INVENTION

The present disclosure relates generally to washing machine appliances, and more particularly to methods for determining load masses in washing machine appliances.

BACKGROUND OF THE INVENTION

Washing machine appliances generally include a tub for containing wash fluid, e.g., water and detergent, bleach and/or other wash additives. A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

One issue with washing machine appliance performance has been the varying masses of articles being washed in the appliance. Operation of the appliance at, for example, a specified speed for a specified time period may not provide optimal performance for every mass. Accordingly, it is generally useful to determine the load mass, in order to tailor appliance performance to these variables.

Attempts have been made to determine load mass in washing machine appliances, and to monitor water levels during operation. However, known methods and apparatus typically involve complex software and sensors, thus increasing the cost of the appliance or preventing commercial use from being viable, or are relatively inaccurate. Additionally, many such methods require calibration before use.

Accordingly, improved methods for determining load masses in washing machine appliances are desired in the art. In particular, methods which have reduced complexity and are generally viable, cost-effective and accurate would be advantageous.

BRIEF DESCRIPTION OF THE INVENTION

In accordance with one embodiment of the present disclosure, a method for determining a load mass in a washing machine appliance, is provided. The method includes accelerating rotation of a basket about a central axis within a tub of the washing machine appliance from a first speed to a second speed greater than the first speed and for a predetermined time measured for acceleration of the basket from the first speed; measuring, during the accelerating step, a check speed of the basket at the predetermined time; and measuring, during the accelerating step, an acceleration time for the tub to accelerate from the first speed to the second speed. The method further includes discontinuing acceleration of the basket after the second speed and the predetermined time have been reached; and measuring a coast time for coasting of the basket from the check speed to the first speed. The method further includes determining a load mass in the basket based on the check speed, the acceleration time, and the coast time.

In accordance with another embodiment of the present disclosure, a washing machine appliance is provided. The washing machine appliance includes a cabinet, a tub disposed within the cabinet, a basket disposed within the tub and rotatable relative to the tub about a central axis, and a motor connected to the basket and operable to rotate the basket. The washing machine appliance further includes a controller in communication with the motor. The controller is configured for accelerating rotation of the basket about the central axis from a first speed to a second speed greater than the first speed and for a predetermined time measured for acceleration of the basket from the first speed; measuring, during the accelerating step, a check speed of the basket at the predetermined time; and measuring, during the accelerating step, an acceleration time for the tub to accelerate from the first speed to the second speed. The controller is further configured for discontinuing acceleration of the basket after the second speed and the predetermined time have been reached; and measuring a coast time for coasting of the basket from the check speed to the first speed. The controller is further configured for determining a load mass in the basket based on the check speed, the acceleration time, and the coast time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
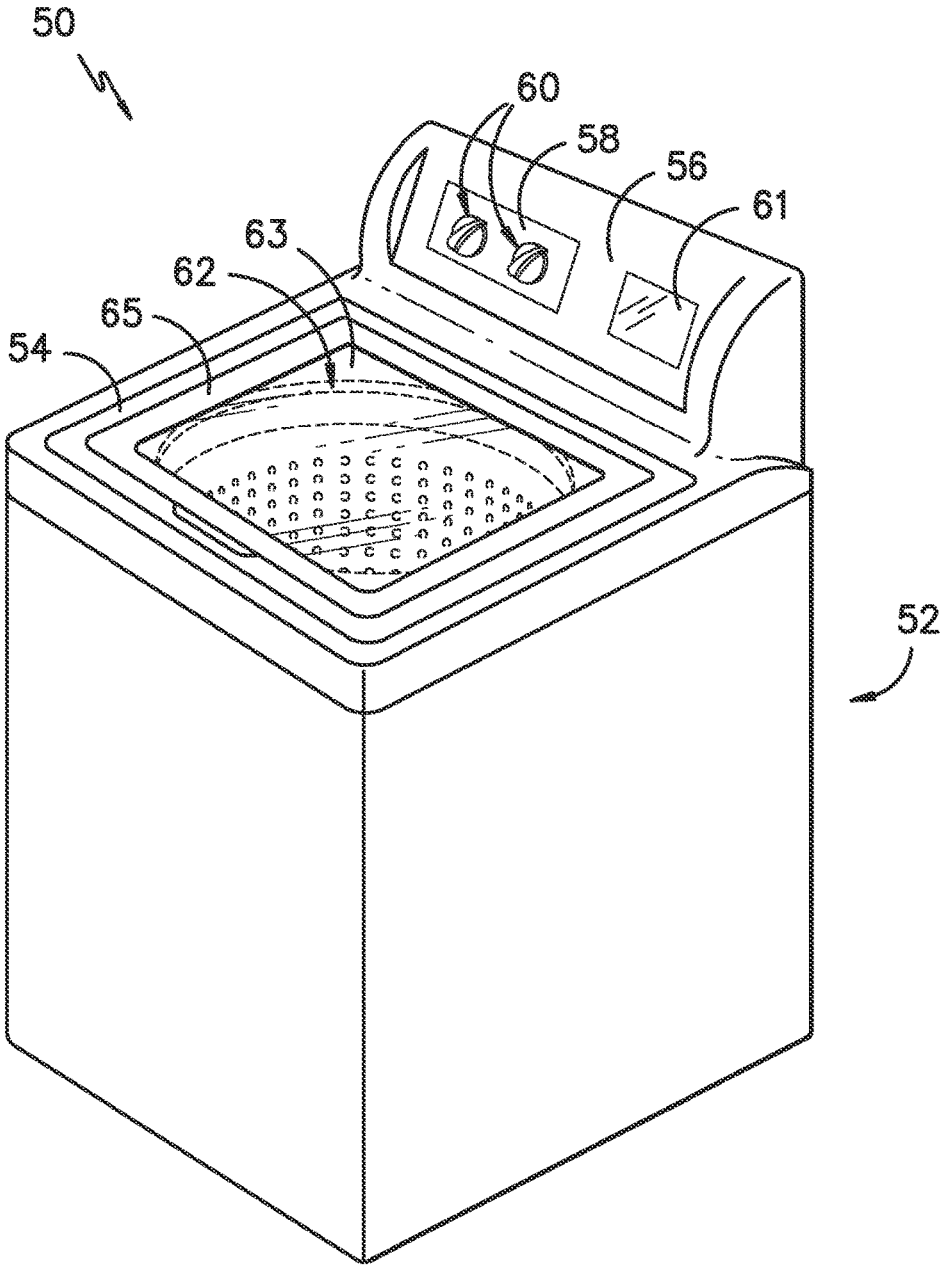
FIG. 1 provides a perspective view of a washing machine appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Lid 62 in exemplary embodiment includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
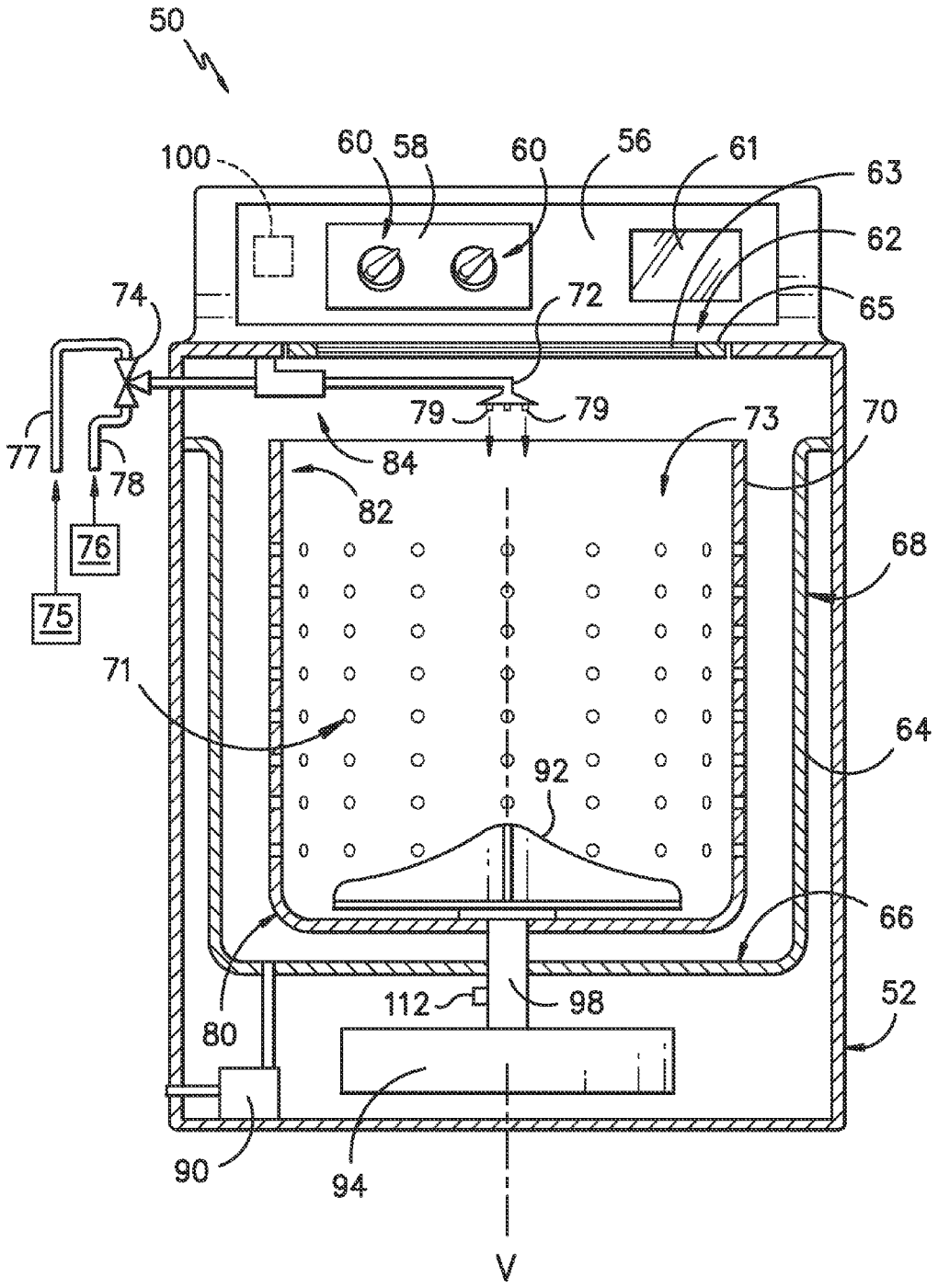
FIG. 2 provides a front, section view of a washing machine appliance in accordance with one embodiment of the present disclosure.

FIG. 2 provides a front, cross-section views of washing machine appliance 50. As may be seen in FIG. 2, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more liquid sources 75, 76 in order to direct liquid (e.g. water) into tub 64 and/or onto articles within chamber 73 of basket 70. Nozzle 72 may further include apertures 79 through which liquid may be sprayed into the tub 64. Apertures 79 may, for example, be tubes extending from the nozzles 72 as illustrated, or simply holes defined in the nozzles 72 or any other suitable openings through which liquid may be sprayed. Nozzle 72 may additionally include other openings, holes, etc. (not shown) through which liquid may be flowed, i.e. sprayed or poured, into the tub 64.

A main valve 74 regulates the flow of fluid through nozzle 72. For example, valve 74 can selectively adjust to a closed position in order to terminate or obstruct the flow of liquid through nozzle 72. The main valve 74 may be in fluid communication with one or more external liquid sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the main valve 74. A cold water conduit 77 and a hot water conduit 78 may supply cold and hot water, respectively, from the sources 75, 76 through valve 74. Valve 74 may further be operable to regulate the flow of hot and cold liquid, and thus the temperature of the resulting liquid flowed into tub 64, such as through the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that liquid flowing through nozzle 72 flows through dispenser 84, mixing with wash additive at a desired time during operation to form a wash fluid before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIG. 2) is located beneath tub 64 and basket 70 for gravity assisted flow to drain tub 64.

An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Alternatively, basket 70 may provide such agitating movement, and agitation element 92 is not required. Basket 70 and agitation element 92 are driven by a motor 94, such as a pancake motor, which may be operably connected to the basket 70 and/or agitation element 92. For example, as motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a suitable speed sensor 112 can be connected to the motor 94, such as to the output shaft 98 thereof, to measure rotational speed and indicate operation of the motor 94. Other suitable sensors, such as temperature sensors, pressure sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIGS. 1 and 2) for user manipulation to select washing machine cycles and features. Controller 100 may further be operatively coupled to various other components of appliance 50, such as main valve 74, motor 94, speed sensor 112, and other suitable sensors, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, a load of laundry articles are loaded into chamber 73 of basket 70, and washing operation is initiated through operator manipulation of control input selectors 60. Tub 64 is filled with water and mixed with detergent to form a liquid or wash fluid. Main valve 74 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70. More specifically, agitation element 92 or basket 70 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 or basket 70 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
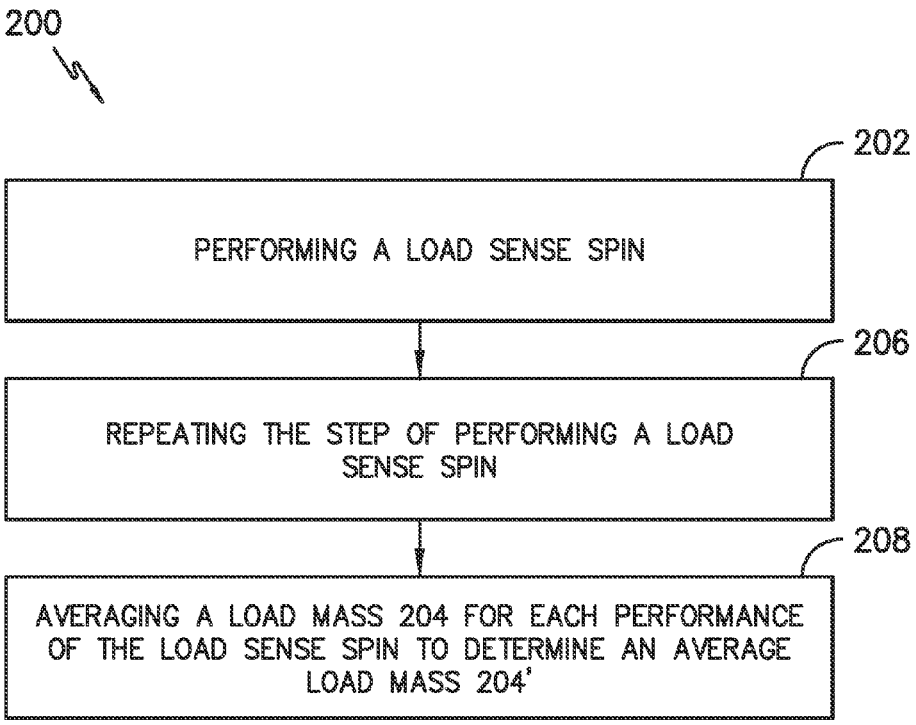
FIG. 3 provides a flow chart of various steps of an exemplary method for determining a load mass in a washing machine appliance in accordance with one embodiment of the present disclosure.
Figure 4:
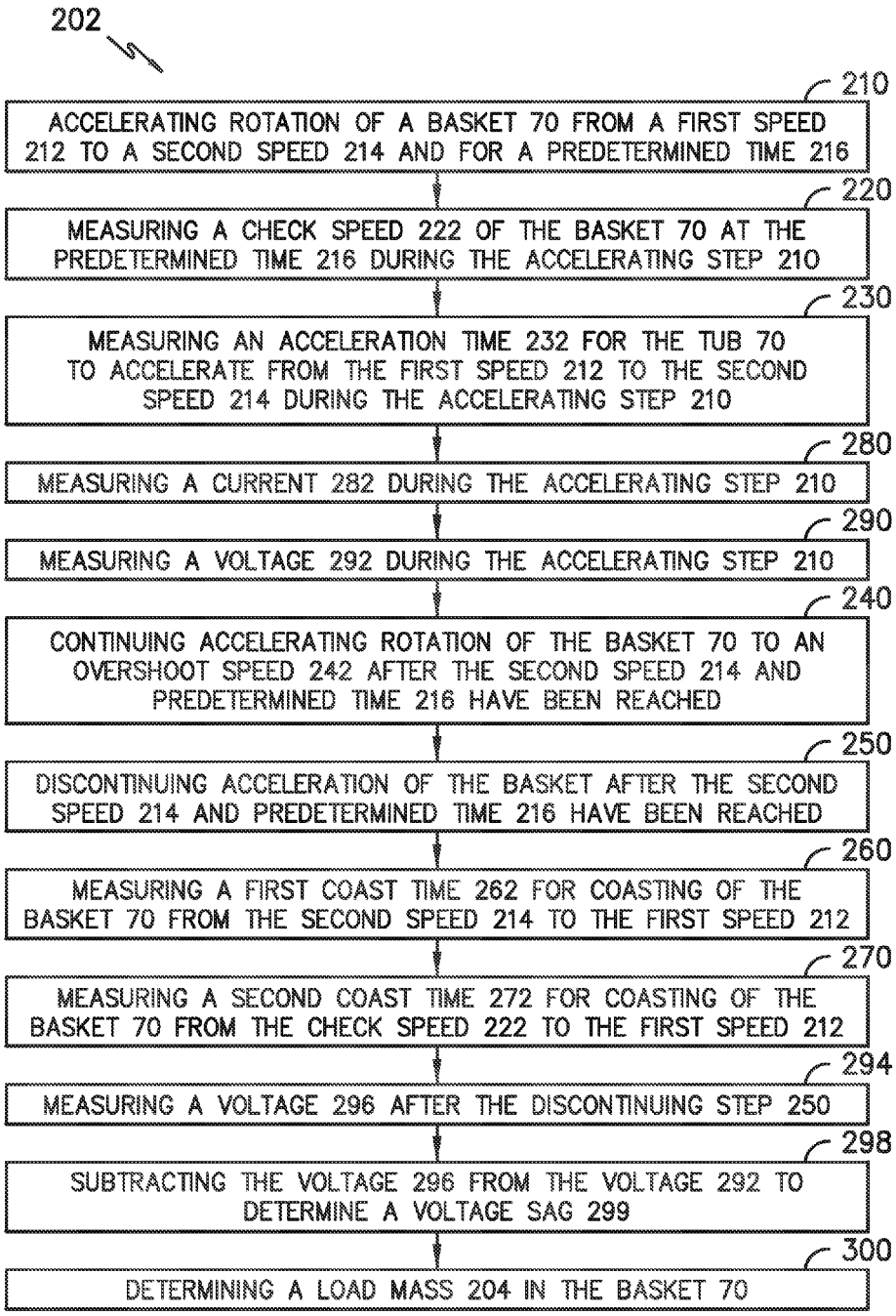
FIG. 4 provides a flow chart of various steps of an exemplary method for determining a load mass in a washing machine appliance in accordance with one embodiment of the present disclosure.

Referring now to FIGS. 3 and 4, various methods may be provided for use with washing machine appliances 50 in accordance with the present disclosure. In general, the various steps of methods as disclosed herein may in exemplary embodiments be performed by the controller 100, which may receive inputs and transmit outputs from various other components of the appliance 50.

For example, as illustrated in FIGS. 3 and 4 and indicated by reference number 200, methods for determining a load mass in a washing machine appliance 50 are provided. Such methods 200 generally accurately and efficiently determined the mass of a load of articles loaded into a basket 70 for washing. Such mass calculation can advantageously be utilized to tailor various operating conditions of the appliance 50, such as agitation time, agitation profile, spin speed, spin time, etc. for optimal wash and energy performance, and can further be utilized to predict a load type for the load and tailor the operating conditions for such load. Additionally, such methods 200 may provide improved accuracy by being relatively more robust to factors such as friction, motor temperature, line voltage variations, etc.

Method 200 may, for example, include the step 202 of performing a load sense spin. The step 202 of performing the load sense spin may include a variety of sub-steps, as discussed herein. A load mass 204 may be determined for and as an output of the step 202. The load mass 204 may be a calculated estimate, based on various inputs and steps as discussed herein, for the mass of a load contained within basket 70.

Method 200 may further include the step 206 of repeating the step 202. Step 206 may be performed once, twice, three times or more, as desired. In exemplary embodiments, step 206 may be performed twice, such that the step 202 is performed a total of three times.

Method 200 may further include the step 208 of averaging the load mass 204 from each performance of the load sense spin step 202 to determine an average load mass 204'.

Alternatively, rather than determining a plurality of load masses 204' and then averaging the load masses 204 to determine average load mass 204', various of the variables utilized in the sub-steps of step 202 as discussed herein may be individually collected, without a load mass 204 initially determined. Upon repeating of step 202, the result for each variable from each performance of step 202 may be averaged with other results for that variable. These average variables may then be utilized in accordance with the present disclosure to determine the load mass 204.

Method 200, and step 202 thereof, may, for example, include the step 210 of accelerating rotation of the basket 70 about the central axis V within the tub 64 from a first speed 212 to a second speed 214 which is greater than the first speed 212 and for a predetermined time 216. Notably, acceleration of the basket 70 may continue in accordance with step 210 for the longer of the predetermined time 216 and a time from the first speed 212 to the second speed 214. Controller 100 may operate motor 94 to accelerate rotation of the basket 70. Notably, in exemplary embodiments such acceleration is at 100% power, with no braking or other modulating of the motor 94, etc. Alternatively, less than 100% power may be utilized.

Step 210 is generally performed after articles forming a load are loaded into the basket 70, and before any substantial amount of water is flowed into the tub 64 to begin washing of the load. Notably, minimal amounts of water may be initially flowed into the tub 64 before such step 210 for various purposes, such as for use in entrapment protection programs. Accordingly, the load mass determined utilizing method 200 is generally a dry load mass.

Method 200, and step 202 thereof, may further include, for example, the step 220 of measuring a check speed 222 of the basket 70 at predetermined time 216. Such step 220 may be performed during the accelerating step 210. The predetermined time 216 may be measured for acceleration of the basket 70 from the first speed 212. Accordingly, a timer (which may be a feature of controller 100 or a separate component in communication with controller 100) may begin keeping time when the basket 70 reaches or exceeds the first speed 212. When the predetermined time 216 is reached, the check speed 222, which is the speed of the basket 70 at such time 216, may be measured.

In some embodiments, one or more sensors 112 may be utilized to detect check speed 222, as well as first and second speeds 212, 214 and other speeds discussed herein. Alternatively, other suitable components or the motor 94, motor shaft 98, controller 100, and/or components thereof may be utilized to detect such speeds.

In some embodiments, the first speed 212 is zero revolutions per minute, and the basket 70 is thus rotationally stationary. Alternatively, however, the first speed may be greater than 0 revolutions per minute ("RPMs"). For example, in some embodiments, the first speed 212 may be between approximately 10 and approximately 30 RPMs. Before the accelerating step 210, the basket 70 may for example be accelerated to the first speed 212. The basket 70 may then continue accelerating through the first speed 212, with step 210 beginning when the first speed 212 is reached as discussed above.

As discussed, the second speed 214 may be greater than the first speed 212. In some embodiments, for example, the second speed 214 is between approximately 120 and approximately 180 RPMs. Additionally, the predetermined time 216 may, for example, be between approximately 1 and approximately 5 seconds.

It should be understood that the first speed 212, second speed 214 and predetermined time 216 are not limited to the above disclosed embodiments, and rather that any suitable speeds, times or ranges thereof are within the scope and spirit of the present disclosure.

Method 200, and step 202 thereof, may further include, for example, the step 230 of measuring an acceleration time 232 for the tub 70 to accelerate from the first speed 212 to the second speed 214. For example, a timer (which may be independent from the above-discussed timer) may start when the tub 70 meets or exceeds the first speed 212 and may stop when the tub 70 meets or exceeds the second speed 214. The resulting time may be the acceleration time 232.

Notably, while in some embodiments acceleration time 232 may be greater than predetermined time 216, in alternative embodiments acceleration time 226 may be equal to or less than predetermined time 216.

Method 200, and step 202 thereof, may further include, for example, the step 240 of continuing accelerating rotation of the basket 70 to an overshoot speed 242 after the second speed 214 and predetermined time 216 are reached. Overshoot speed 242 may be greater than second speed 214 and may further be greater than check speed 222 and, for example, in some embodiments may be in the range between approximately 140 and approximately 200 RPMs.

Method 200, and step 202 thereof, may further include, for example, the step 250 of discontinuing acceleration of the basket after the second speed 214 and the predetermined time 216 have been reached. For example, operation of the motor 94, such as by controller 100, may be discontinued. In some embodiments, after such discontinuation in accordance with the present disclosure, no braking may occur. Alternatively, however, braking may occur. Rather the basket 70 may be allowed to freely rotate, i.e. coast, after such discontinuation. Step 250 may occur in some embodiments after step 240. Alternatively, however, step 240 may not be utilized, and step 250 may occur immediately upon the second speed 214 and predetermined time 216 both being reached.

Method 200, and step 202 thereof, may further include, for example, the step 260 of measuring a coast time 262, such as a first coast time 262, for coasting of the basket 70 from the second speed 214 to the first speed 212. For example, as the basket 70 is coasting and thus decelerating, a timer (which may be independent of other timers discussed herein) may start when the second speed 214 is reached (i.e. met or passed during deceleration) and stopped when the first speed 212 is reached (i.e. met or passed during deceleration).

Method 200, and step 202 thereof, may further include, for example, the step 270 of measuring a coast time 272, such as a second coast time 272, for coasting of the basket 70 from the check speed 222 to the first speed 212. For example, as the basket 70 is coasting and thus decelerating, a timer (which may be independent of other timers discussed herein) may start when the check speed 222 is reached (i.e. met or passed during deceleration) and stopped when the first speed 212 is reached (i.e. met or passed during deceleration).

Further, in some embodiments, various electrical measurements may be made, such as of the motor 94, during the accelerating step 210 and/or after the discontinuing step 250. These electrical measurements, which may for example, be current and/or voltage measurements, may, for example, be measured by the controller 100 in communication with the motor 94, such as through the use of suitable sensors included in or in communication with the motor 94.

For example, method 200, and step 202, may further include the step 280 of measuring a current 282 to the appliance 50, such as to the motor 94 thereof. Such step 280 may, for example, occur during the accelerating step 210. For example, during the accelerating step 210, the current 282 may be sampled at a suitable rate, and the collected samples averaged as current 282.

Method 200, and step 202, may further include the step 290 of measuring a voltage 292 to the appliance 50, such as to the motor 94 thereof (i.e. of the electrical line providing power to the appliance 50, such as to the motor 94 thereof). Such step 290 may, for example, occur during the accelerating step 210. For example, during the accelerating step 210, the voltage 292 may be sampled at a suitable rate, and the collected samples averaged as voltage 292. Notably, in exemplary embodiments, the root mean square voltage may be utilized, and may be sampled and averaged. Alternatively, the peak voltage or another suitable voltage value may be utilized.

Method 200, and step 202, may further include the step 294 of measuring a voltage 296 to the appliance 50 (i.e. of the electrical line providing power to the appliance 50). Such step 294 may, for example, occur after the discontinuing step 250, i.e. during coasting of the basket 70. For example, during this period, the voltage 296 may be sampled at a suitable rate, and the collected samples averaged as voltage 296. Notably, in exemplary embodiments, the root mean square voltage may be utilized, and may be sampled and averaged. Alternatively, the peak voltage or another suitable voltage value may be utilized.

Further, in some embodiments a voltage sag value 299 may be determined. For example, method 200, and step 202, may further include the step 298 of subtracting the voltage 296 from the voltage 292 to determine the voltage sag 299.

Method 200, and step 202, may further include the step 300 of determining a load mass 204 in the basket 70. The determining step 300 may be based on, for example, one or more of the check speed 222, the acceleration time 232, the first coast time 262, the second coast time 272, the current 282, the voltage 292, the voltage 296 and/or the voltage sag 299. For example, in some embodiments, step 300 may include the step of utilizing a transfer function to determine the load mass 204. The one or more of the check speed 222, the acceleration time 232, the first coast time 262, the second coast time 272, the current 282, the voltage 292, the voltage 296 and/or the voltage sag 299 may be inputs to the transfer function. One embodiment of a suitable transfer function for use in accordance with the present disclosure is as follows:

$$W=A+B\omega_c+Ct_{r2}+Et_{c2}+GV_2+It+J\omega_c^2+Kt_{r2}^2+Mt_{c2}^2+OV_2^2+Qt^2$$

wherein:

W is the load mass;

$\omega_c$ is the check speed;

$t_{r2}$ is the acceleration time;

$t_{c2}$ is the second coast time;

$V_2$ is the voltage measured after the discontinuing step 250;

i is the current; and

A, B, C, E, G, I, J, K, M, O and Q are constants.

Another embodiment of a suitable transfer function for use in accordance with the present disclosure is as follows:

$$W=A+B\omega_c+Ct_{r2}+Dt_{c1}+Et_{c2}+FV_1+GV_2+HV_{sag}+It+J\omega_c^2+Kt_{r2}^2+Lt_{c1}^2+Mt_{c2}^2+NV_1^2+OV_2^2+PV_{sag}^2+Qt^2$$

wherein:

W is the load mass;

$\omega_c$ is the check speed;

$t_{r2}$ is the acceleration time;

$t_{c1}$ is the first coast time;

$t_{c2}$ is the second coast time;

$V_1$ is the voltage measured during the accelerating step 210;

$V_2$ is the voltage measured after the discontinuing step 250;

$V_{sag}$ is the voltage sag;

i is the current; and

A, B, C, D, E, F, G, H, I, J, K, L, M, N, O, P and Q are constants.

Notably, constants A through Q utilized in the above disclosed embodiments of the transfer function may in exemplary embodiments be empirically determined, such as through reasonable experimentation, and these constants and the transfer function itself may, for example, be programmed into controller 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for determining a load mass in a washing machine appliance, the method comprising:

accelerating rotation of a basket about a central axis within a tub of the washing machine appliance from a first speed to a second speed greater than the first speed and for a predetermined time measured for acceleration of the basket from the first speed;

measuring, during the accelerating step, a check speed of the basket at the predetermined time;

measuring, during the accelerating step, an acceleration time for the tub to accelerate from the first speed to the second speed;

discontinuing acceleration of the basket after the second speed and the predetermined time have been reached;

measuring a coast time for coasting of the basket from the check speed to the first speed; and determining a load mass in the basket based on the check speed, the acceleration time, and the coast time, wherein the first speed, the second speed, and the check speed are each a discrete predetermined speed, wherein accelerating rotation comprises continued acceleration until both the second speed is reached and the predetermined time has elapsed, wherein determining the load mass comprises calculating the load mass according to a transfer function, and wherein the check speed, the acceleration time, and the coast time are each discrete inputs to the transfer function.

2. The method of claim 1, wherein the coast time is a second coast time, and further comprising the step of measuring a first coast time for coasting of the basket from the second speed to the first speed.

3. The method of claim 1, further comprising measuring a current to the washing machine appliance during the accelerating step.

4. The method of claim 1, further comprising measuring a voltage to the washing machine appliance during the accelerating step.

5. The method of claim 4, further comprising measuring a voltage to the washing machine appliance after the discontinuing step.

6. The method of claim 5, further comprising subtracting the voltage after the discontinuing step from the voltage during the accelerating step to determine a voltage sag, wherein the voltage sag is a discrete input to the transfer function.

7. The method of claim 1, further comprising continuing accelerating rotation of the basket to an overshoot speed after the second speed and predetermined time have been reached.

8. The method of claim 1, wherein the first speed is between approximately 10 and approximately 30 revolutions per minute.

9. The method of claim 1, wherein the second speed is between approximately 120 and approximately 180 revolutions per minute.

10. The method of claim 1, wherein the predetermined time is between approximately 1 and approximately 5 seconds.

11. The method of claim 1, comprising performing a load sense spin, wherein the step of performing the load sense spin comprises performing the accelerating step, the step of measuring the check speed, the step of measuring the acceleration time, the discontinuing step, the step of measuring the coast time, and the determining step.

12. The method of claim 11, further comprising:

repeating the step of performing the load sense spin; and averaging the load mass from each performance of the load sense spin to determine an average load mass.

13. A washing machine appliance, the washing machine appliance comprising:

a cabinet;

a tub disposed within the cabinet;

a basket disposed within the tub and rotatable relative to the tub about a central axis;

a motor connected to the basket and operable to rotate the basket; and a controller in communication with the motor, the controller configured to initiate:

accelerating rotation of the basket about the central axis from a first speed to a second speed greater than the first speed and for a predetermined time measured for acceleration of the basket from the first speed;

measuring, during the accelerating step, a check speed of the basket at the predetermined time;

measuring, during the accelerating step, an acceleration time for the tub to accelerate from the first speed to the second speed;

discontinuing acceleration of the basket after the second speed and the predetermined time have been reached;

measuring a coast time for coasting of the basket from the check speed to the first speed; and determining a load mass in the basket based on the check speed, the acceleration time, and the coast time, wherein the first speed, the second speed, and the check speed are each a discrete predetermined speed, wherein accelerating rotation comprises continued acceleration until both the second speed is reached and the predetermined time has elapsed, wherein determining the load mass comprises calculating the load mass according to a transfer function, and wherein the check speed, the acceleration time, and the coast time are each discrete inputs to the transfer function.

14. The washing machine appliance of claim 13, wherein the coast time is a second coast time, and wherein the controller is further configured to initiate measuring a first coast time for coasting of the basket from the second speed to the first speed.

15. The washing machine appliance of claim 13, wherein the controller is further configured to initiate measuring a current to the washing machine appliance during the accelerating step.

16. The washing machine appliance of claim 13, wherein the controller is further configured to initiate:

measuring a voltage to the washing machine appliance during the accelerating step;

measuring a voltage to the washing machine appliance after the discontinuing step; and subtracting the voltage after the discontinuing step from the voltage during the accelerating step to determine a voltage sag, wherein the voltage sag is a discrete input to the transfer function.

17. The washing machine appliance of claim 13, wherein the controller is further configured to initiate continuing accelerating rotation of the basket to an overshoot speed after the second speed and predetermined time have been reached.

* * * * *